US007164771B1

(12) United States Patent
Treurniet et al.

(10) Patent No.: US 7,164,771 B1
(45) Date of Patent: Jan. 16, 2007

(54) PROCESS AND SYSTEM FOR OBJECTIVE AUDIO QUALITY MEASUREMENT

(75) Inventors: William C. Treurniet, Nepean (CA); Louis Thibault, Hull (CA); Gilbert Arthur Joseph Soulodre, Kanata (CA)

(73) Assignee: Her Majesty the Queen as Represented by the Minister of Industry through the Communications Research Centre, Ontario (CA)

( * ) Notice: Subject to any disclaimer, the term of this patent is extended or adjusted under 35 U.S.C. 154(b) by 0 days.

(21) Appl. No.: 09/577,649

(22) Filed: May 24, 2000

Related U.S. Application Data

(63) Continuation-in-part of application No. PCT/CA99/00258, filed on Mar. 25, 1999.

(30) Foreign Application Priority Data

Mar. 27, 1998 (CA) ..... 2230188

(51) Int. Cl.
*H04R 29/00* (2006.01)

(52) U.S. Cl. ..... 381/56; 704/200.1; 73/585

(58) Field of Classification Search ..... 381/56, 381/151, 326; 607/55, 56, 57; 600/25; 73/585; 704/200.1
See application file for complete search history.

(56) References Cited

U.S. PATENT DOCUMENTS 4,860,360 A 8/1989 Boggs
4,862,492 A 8/1989 Zwick
5,490,204 A 2/1996 Gulledge
5,621,854 A * 4/1997 Hollier ..... 704/200.1
5,758,027 A 5/1998 Meyers et al.
5,794,188 A 8/1998 Hollier
5,809,453 A * 9/1998 Hunt ..... 704/214

FOREIGN PATENT DOCUMENTS

WO WO 98/08295 2/1998

OTHER PUBLICATIONS

Recommendation Telecommunication Union- Radiocommunication Sector BS 1387-1, Geneva, 1998.*

OPTICOM, "List of corrections of the ITU-R Recommentation BS.1387", 2001.*

Recommendation Telecommunication Union- Radiocommunication Sector BS.1387, Geneva, 1998.*

M. Treisman, "Features and Objects in Visual Processing", Scientific American, 255[5]: 114-124, 1986.

Slaney, M. (1193). "An Efficient Implementation of the Patterson-Holdsworth Auditory Filter Bank", Apple Computer Technical Report #35, Apple Computer Inc.

M. Florentine and S. Buus, "An Excitation-Pattern Model for Intensity Discrimination", J. Acoust. Soc. Am., 70: 1646-1654, 1981.

(Continued)

*Primary Examiner*—Vivian Chin
*Assistant Examiner*—Con P. Tran
(74) *Attorney, Agent, or Firm*—Heslin Rothenberg Farley & Mesiti P.C.; Jeff Rothenberg, Esq.

(57) ABSTRACT

A process and system for providing objective quality measurement of a target audio signal. Reference and target signals are processed by a peripheral ear processor, and compared to provide a basilar degradation signal. A cognitive processor employing a neural network then determines an objective quality measure from the basilar degradation signal by calculating certain key cognitive model components.

16 Claims, 8 Drawing Sheets

OTHER PUBLICATIONS

B. Paillard, P. Mabilleau, S. Morisette, and J. Soumagne, "Perceval: Perceptual Evaluation of the Quality of Audio Signals", J. Audio Eng. Soc., vol. 40, pp. 21-31, 1992.

C. Colomes., M. Lever, J. B. Rault, and Y. F. Dehery, "A Perceptual Model Applied to Audio Bit-Rate Reduction", J. Audio Eng. Soc. vol. 43, pp. 233-240, Apr. 1995.

K. Brandenburg and T. Sporer, "'NMR' and 'Masking Flag': Evaluation of Quality Using Perceptual Criteria", 11th International AES Conference on Audio Test and Measurement, Portland, 1992, pp. 169-179.

T. Thiede and E. Kabot, "A New Perceptual Quality Measure for Bit Rate Reduced Audio", Proceedings of the Audio Engineering Society, Copenhagen, Denmark, Reprint No. 4280, 1996.

E. Terhardt, G. Stoll, M. Sweeman,"Algorithm for Extraction of Pitch and Pitch Salience from Complex Tonal Signals", J. Acoust. Soc. Am. 71(3): 678-688, 1982.

E. Zwicker and E. Terhardt, "Analytical Expressions for Critical-Band Rate and Critical Bandwidth as a Function of Frequency", J. Acoust. Soc. Am. 68(5): 1523-1525, 1980.

Treurniet, W. C., "Simulation of Individual Listeners with an Auditory Model", Proceedings of the Audio Engineering Society, Copenhagen, Denmark, Reprint No. 4154, 1996.

Thiede, supra, and J. G. Beerends, "Measuring the Quality if Speech and Music Codecs, an Integrated Psychoacoustic Approach", Proceedings of the Audio Engineering Society, Copenhagen, Denmark, Reprint No. 4154, 1996.

E. Hearst, "Psychology and Nothing", American Scientist, 79:432-443, 1979.

J.G. Beerends and J.A. Stemerdink, "A Perceptual Audio Quality Measure Based on a Psychoacoustic Sound Representation", J. Audio Eng. Soc., vol. 40, No. 12, Dec. 1992, pp. 963-978.

* cited by examiner

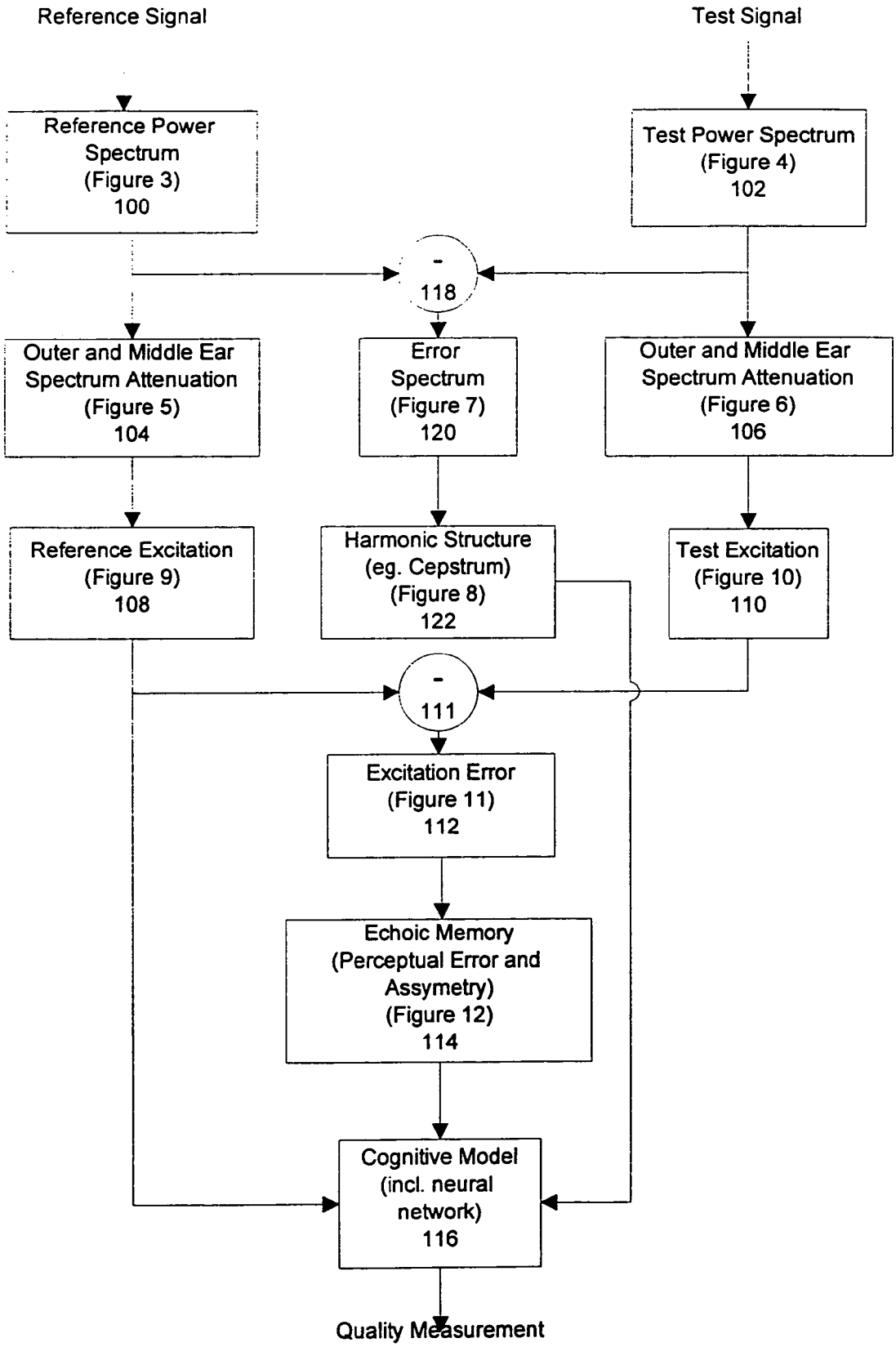
Figure 2B Model Flow Chart

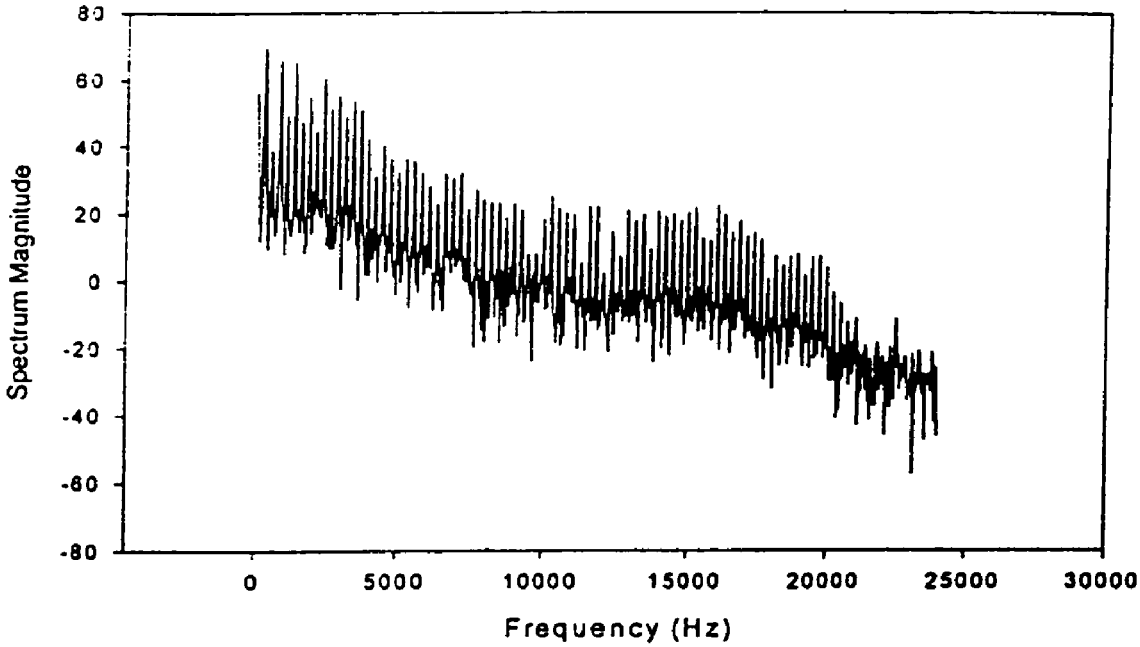
Figure 3. Reference spectrum
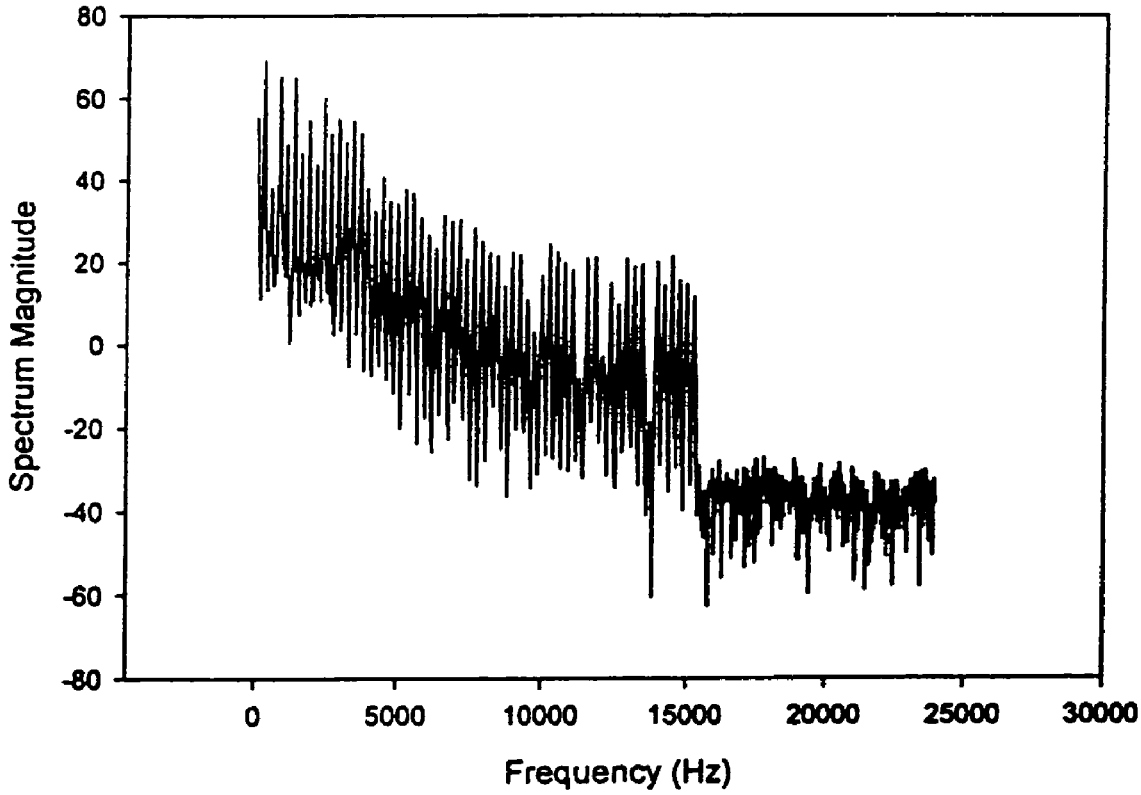
Figure 4. TestA spectrum

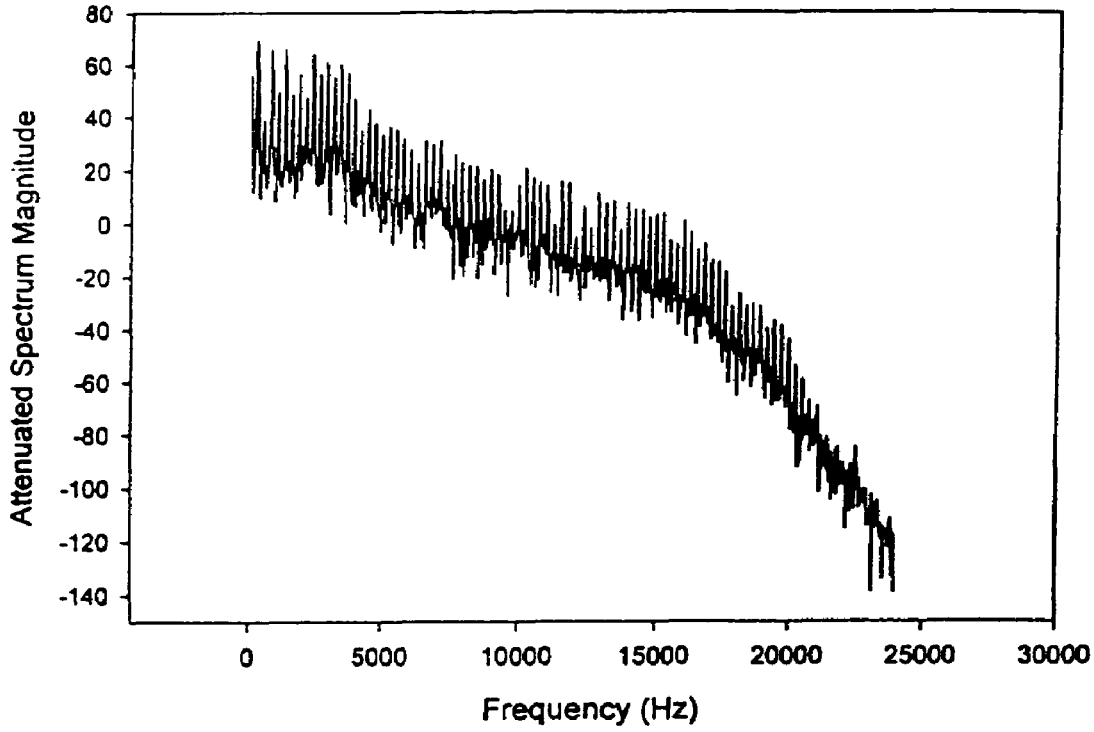
Figure 5. Middle ear attenuation of reference spectrum
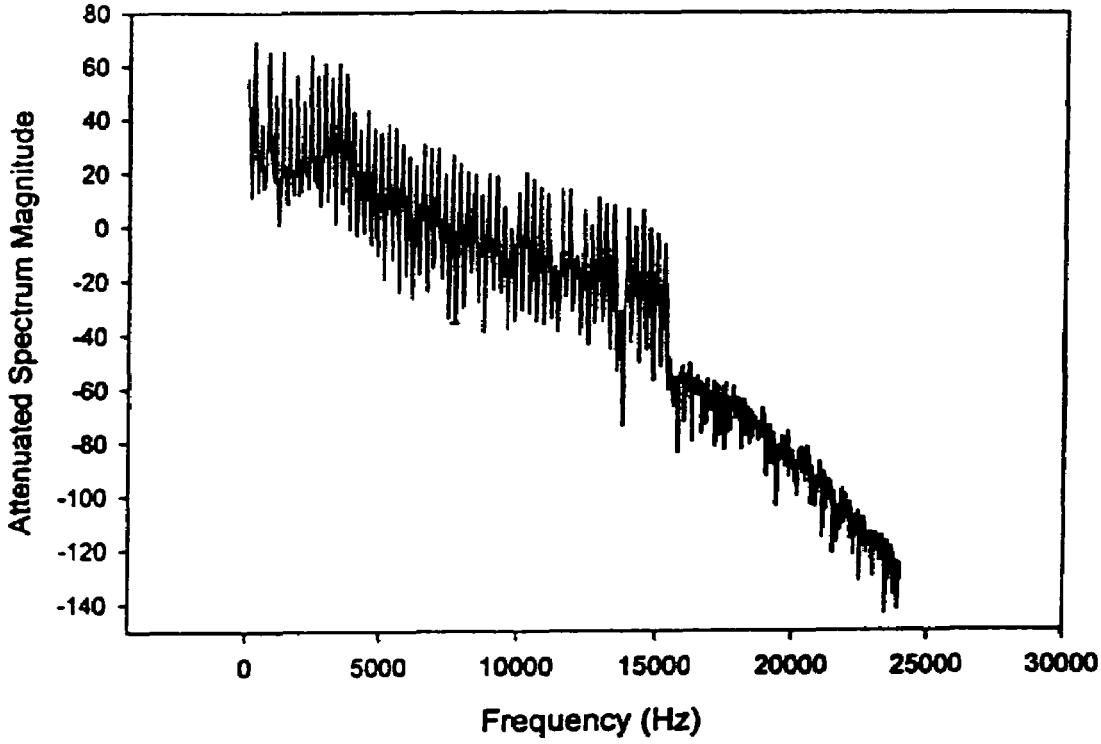
Figure 6. Middle ear attenuation of TestA spectrum

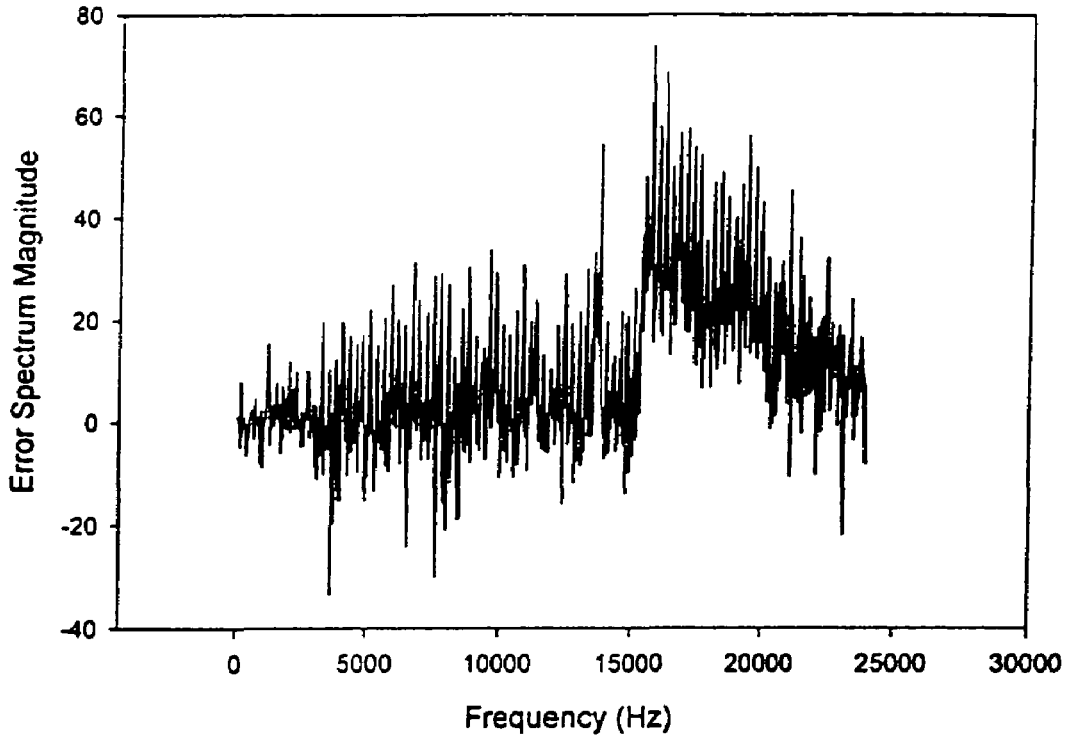
Figure 7. TestA error spectrum
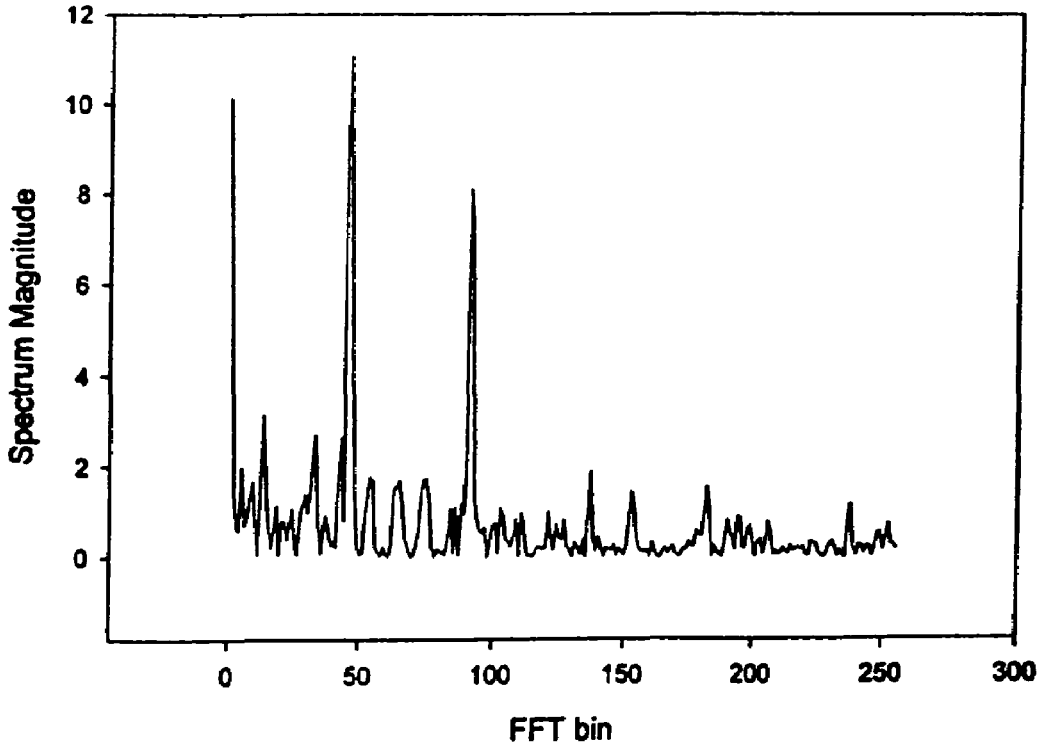
Figure 8. TestA error cepstrum

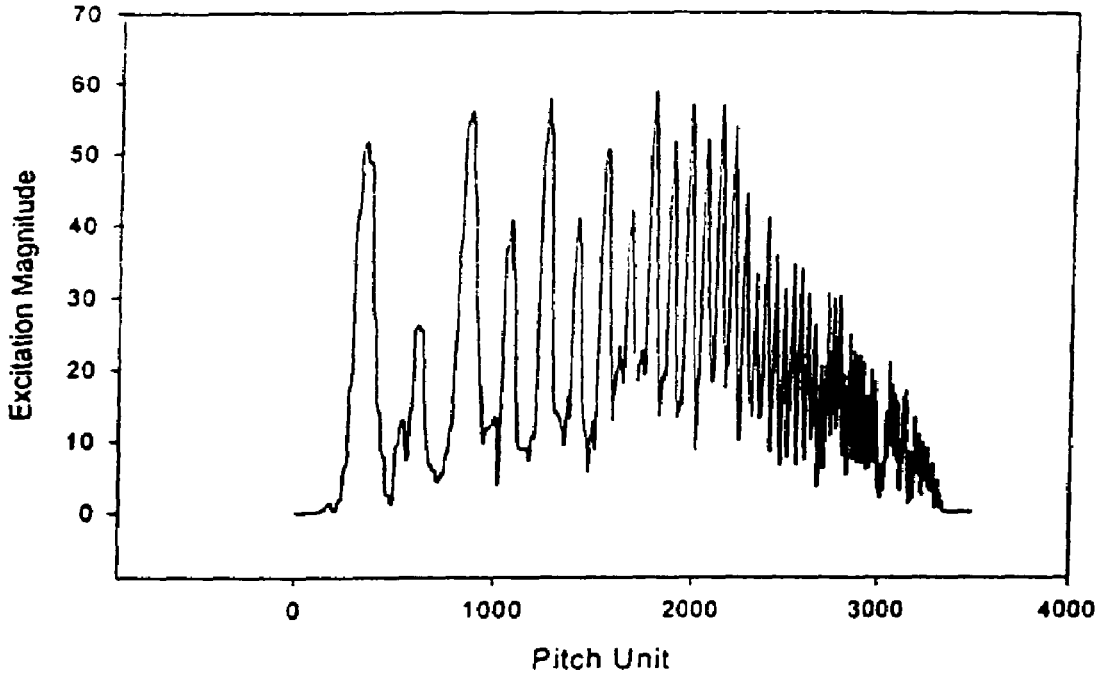
Figure 9. Reference excitation
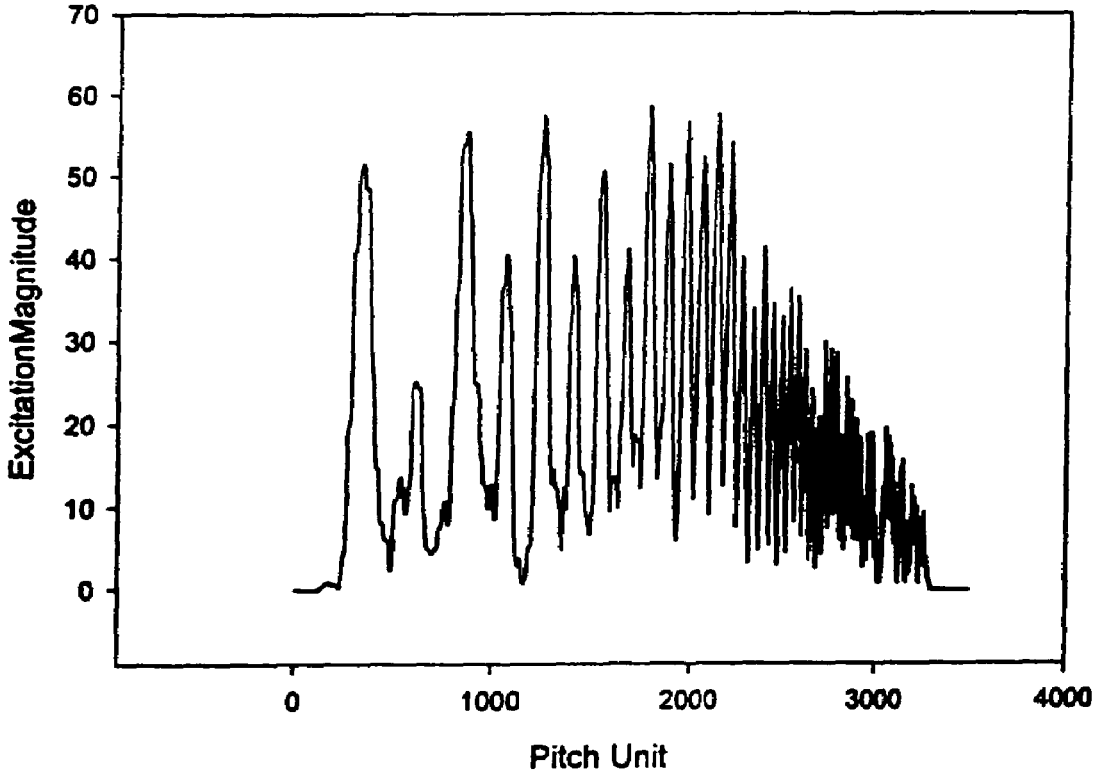
Figure 10. TestA excitation

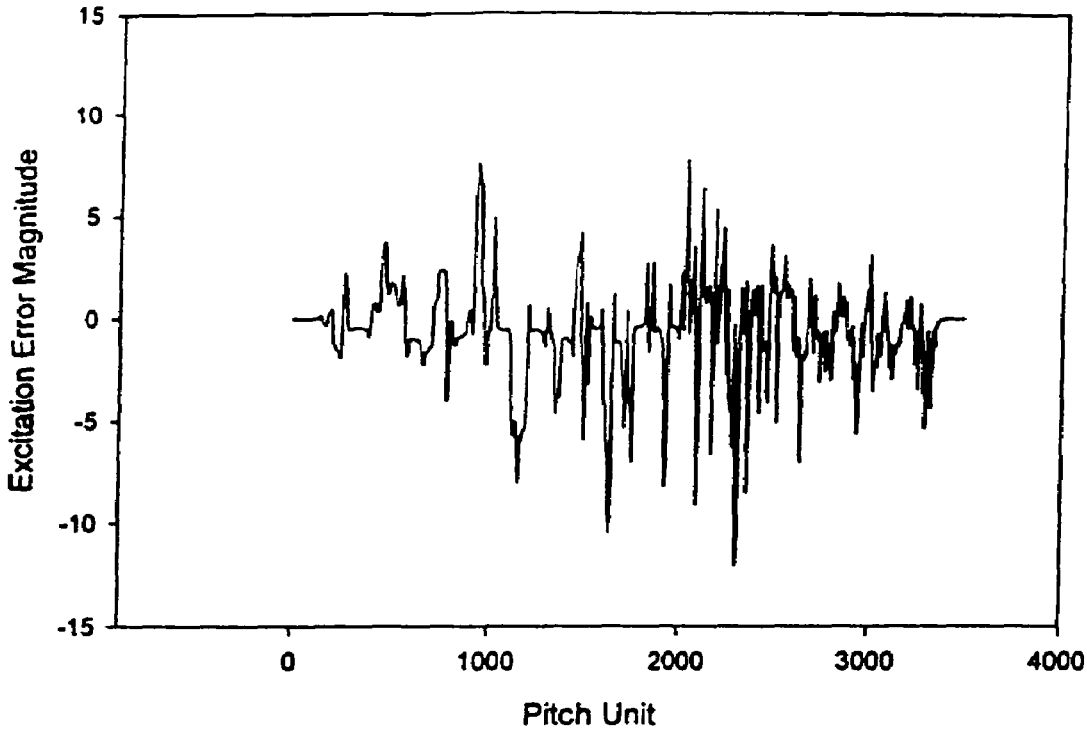
Figure 11. TestA excitation error
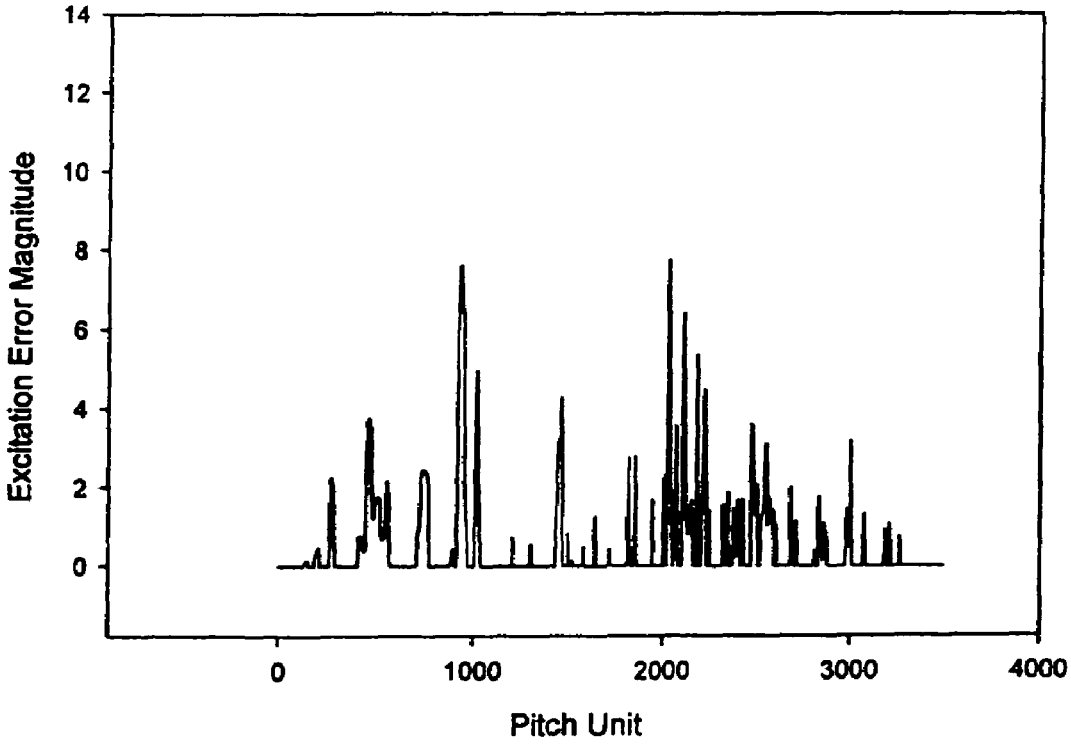
Figure 12. TestA echoic memory output

PROCESS AND SYSTEM FOR OBJECTIVE AUDIO QUALITY MEASUREMENT

CROSS REFERENCES TO RELATED APPLICATIONS

This is a continuation-in-part of International Application PCT/CA99/00258, with an international filing date of Mar. 25, 1999, and claims priority of Canadian Application No. 2,230,188 filed on Mar. 27, 1998.

FIELD OF THE INVENTION

The present invention relates to a process and system for measuring the quality of audio signals. In particular, the present invention relates to a process and system for objective audio quality measurement, such as determining the relative perceivable differences between a digitally processed audio signal and an unprocessed audio signal.

BACKGROUND OF THE INVENTION

A quality assessment of audio or speech signals may be obtained from human listeners, in which listeners are typically asked to judge the quality of a processed audio or speech sequence relative to an original unprocessed version of the same sequence. While such a process can provide a reasonable assessment of audio quality, the process is labour-intensive, time-consuming and limited to the subjective interpretation of the listeners. Accordingly, the usefulness of human listeners for determining audio quality is limited in view of these restraints. Thus, the application of audio quality measurement has not been applied to areas where such information would be useful.

For example, a system for providing objective audio quality measurement would be useful in a variety of applications where an objective assessment of the audio quality can be obtained quickly and efficiently without involving human testers each time an assessment in required. Such applications include: the assessment or characterization of implementations of audio processing equipment; the evaluation of equipment or a circuit prior to placing it into service (perceptual quality line up); on-line monitoring processes to monitor audio transmissions in service; audio codec development involving comparisons of competing encoding/compression algorithms; network planning to optimize the cost and performance of a transmission network under given constraints; and, as an aid to subjective assessment, for example, as a tool for screening critical material to include in a listening test.

Current objective measures of audio or speech quality include THD (Total Harmonic Distortion) and SNR (Signal-to-Noise Ratio). The latter metric can be measured on either the time domain signal or a frequency domain representation of the signal. However, these measures are known to provide a very crude measure of audio or speech quality and are not well correlated with the subjective quality of a processed sound as compared to a test sound as determined by a human listener. Furthermore, this lack of correlation worsens when these metrics are used to measure the quality of devices such as A/D and D/A converters and perceptual audio (or speech) codecs which make use of the masking properties of the human auditory system often resulting in audio (or speech) signals being perceived as being of good or excellent quality even though the measured SNR may be poor.

Some methods and systems for measurement of objective perceptual quality of wide-band audio have been proposed.

However, all of these methods and systems employ algorithms that have been shown to result in inadequate levels of performance in tests conducted by the ITU-R (International Telecommunications Union-Radio Communications) in 1995–1996. Such methods and systems include J. G. Beerends and J. A. Stemerdink, "A perceptual audio quality measure based on a psychoacoustic sound representation", *J. Audio Eng. Soc.,* Vol. 40, pp. 963–978, December 1992; C. Colomes, M. Lever, J. B. Rault, and Y. F. Dehery, "A perceptual model applied to audio bit-rate reduction", *J. Audio Eng. Soc.,* Vol. 43, pp. 233–240, April 1995; K. Brandenburg and T. Sporer. "'NMR' and 'Masking Flag': Evaluation of quality using perceptual criteria", 11$^{th}$ *International AES Conference on Audio Test and Measurement,* Portland, 1992, pp. 169–179; T. Thiede and E. Kabot, "A New Perceptual Quality Measure for Bit Rate Reduced Audio", *Proceedings of the Audio Engineering Society,* Copenhagen, Denmark, Reprint Number 4280, 1996.

Accordingly, there is a need for an efficient system and methodology for obtaining an estimate of the perceptual quality of an audio or speech sequence, particularly audio or speech sequences that have been processed in some manner, that provides acceptable performance and that permits frequent and automated monitoring of audio or speech equipment performance and the degree of communication network degradation

SUMMARY OF THE INVENTION

It is an object of the present invention to provide a process and system for determining an objective perceptual quality rating of a target audio signal that obviates or mitigates at least one disadvantage of the prior art. In particular, it is an object of the present invention to provide a process and system for determining an objective perceptual quality rating for an audio signal that permits automated monitoring of audio signals in an efficient manner.

In a first aspect, the present invention provides a process for determining an objective measurement of audio quality. A reference audio signal and a target audio signal are processed according to a peripheral ear model to provide a reference basilar sensation signal and a target basilar sensation signal, respectively. The reference basilar sensation signal and the target basilar sensation signal are then compared to provide a basilar degradation signal. The basilar degradation signal is then processed according to a cognitive model to determine at least one cognitive model component. And, finally the objective perceptual quality rating is calculated from the at least one cognitive model component.

According to presently preferred embodiments of the present invention, the at least one cognitive model component is selected from average distortion level, maximum distortion level, average reference level, reference level at maximum distortion, coefficient of variation of distortion, and correlation between reference and distortion patterns. A harmonic structure in an error spectrum obtained through a comparison of the reference and target audio signal can also be included.

Typically, the process of the present invention uses a level-dependent or a frequency dependent spreading function having a recursive filter. The process of the present invention can also include separate weighting for adjacent frequency ranges, and determining effects of at least one of perceptual inertia, perceptual asymmetry and adaptive threshold prior to determining the at least one cognitive model component.

The present invention also provides a system for determining an objective audio quality measurement of a target audio signal. Generally, the system is implemented in a computer provided with appropriate application programming. The system consists of a peripheral ear processor for processing a reference audio signal and a target audio signal to provide a reference basilar sensation signal and a target basilar sensation signal, respectively. A comparator compares the reference basilar sensation signal and the target basilar sensation signal to determine a basilar degradation signal. Finally, a cognitive processor processes the basilar degradation signal to determine at least one cognitive model component for providing an objective perceptual quality rating.

In a presently preferred embodiment, the cognitive processor of the present system is implemented with a multilayer neural network and pre-processing means for determining effects of at least one of perceptual inertia, perceptual asymmetry and adaptive threshold. As well, weighting means are provided for adjacent frequency ranges.

BRIEF DESCRIPTION OF THE DRAWINGS

Preferred embodiments of the present invention will now be described, by way of example only, with reference to the attached Figures, wherein:

FIG. 2B shows a flow chart of the processing of a reference and test signal to obtain a quality measurement;

FIG. 3 shows a representative reference power spectrum;

FIG. 4 shows a representative test power spectrum;

FIG. 5 shows a representative middle ear attenuation spectrum of the reference signal;

FIG. 6 shows a representative middle ear attenuation spectrum of the test signal;

FIG. 7 shows a representative error spectrum from the reference and test signals;

FIG. 8 shows a representative error cepstrum from the reference and test signals;

FIG. 9 shows a representative excitation spectrum from the reference signal;

FIG. 10 shows a representative excitation spectrum from the test signal;

FIG. 11 shows a representative excitation error signal; and

FIG. 12 shows a representative echoic memory output signal.

DETAILED DESCRIPTION

Generally, the present invention provides an objective audio quality measurement system in which the peripheral auditory processes are simulated to create a basilar membrane representation of a target audio signal. To assess the quality of the audio sequence, the basilar membrane representation of the target audio signal is subsequently subjected to simple transformations based on assumptions about higher level perceptual, or cognitive, processing, in order to provided an estimated perceptual quality of the target signal relative to a known reference signal. Calibration of the system is achieved by using data obtained from human observers in a number of listening tests.

In developing a system for objective audio quality measurement, the physical shape and performance of the ear is first considered to develop a peripheral ear model. The primary regions of the ear include an outer portion, a middle portion and an inner portion. The outer ear is a partial barrier to external sounds and attenuates the sound as a function of frequency. The ear drum, at the end of the ear canal, transmits the sound vibrations to a set of small bones in the middle ear. These bones propagate the energy to the inner ear via a small window in the cochlea. A spiral tube within the cochlea contains the basilar membrane that resonates to the input energy according to the frequencies present. That is, the location of vibration of the membrane for a given input frequency is a monotonic, non-linear function of frequency. The distribution of mechanical energy along the membrane is called the excitation pattern. The mechanical energy is transduced to neural activity via hair cells connected to the basilar membrane, and the distribution of neural activity is passed to the brain via the fibres in the auditory nerve.

Figure 1:
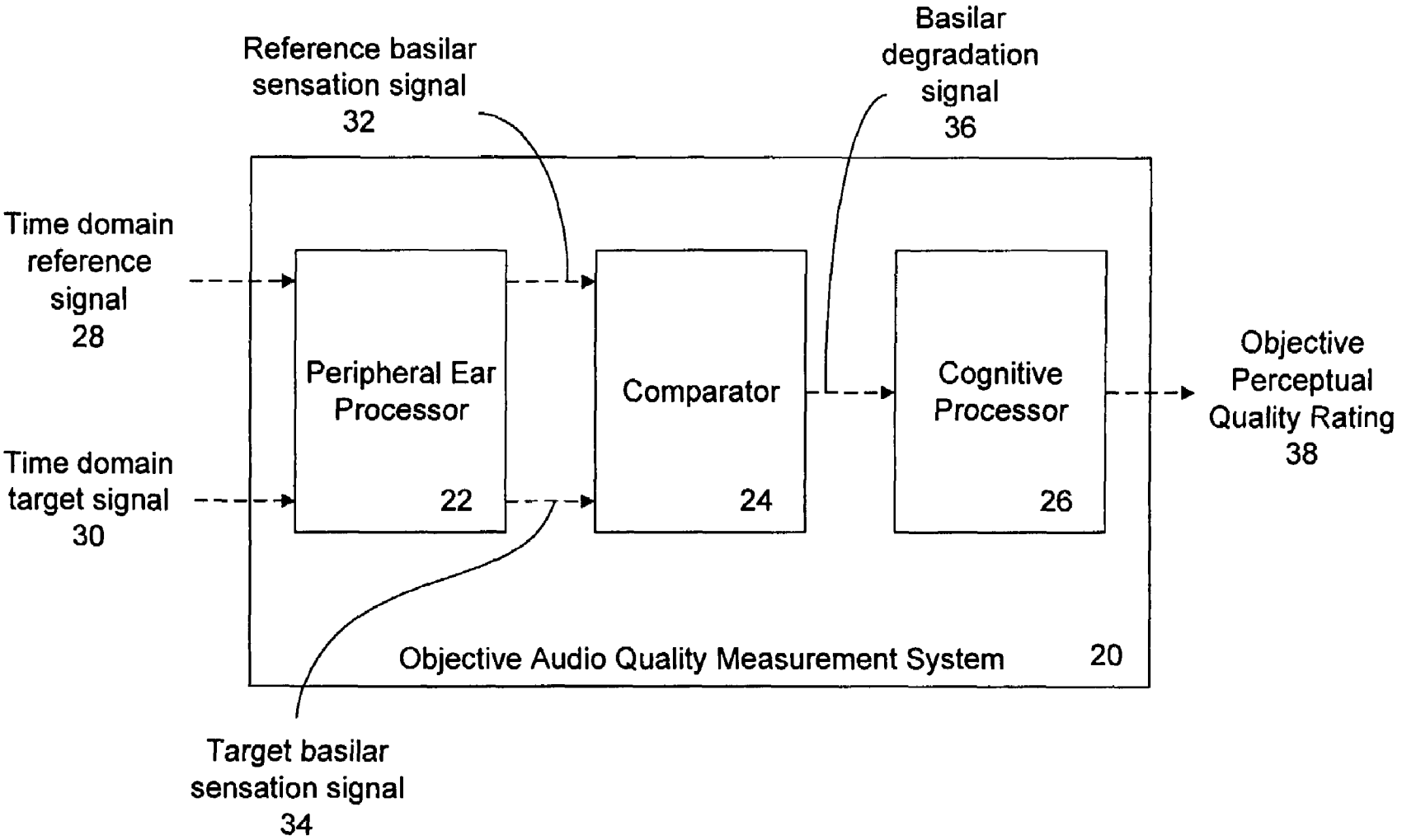
FIG. 1 is a high level representation of a peripheral ear and cognitive model of audition developed as a tool for objective evaluation of the perceptual quality of audio signals.

A high level representation of a system according to the present invention is shown in FIG. 1, and generally referenced at reference numeral 20. System 20 consists of a peripheral ear processor 22 that processes signals according to a peripheral ear model, a comparator 24 that compares output signals from peripheral ear processor 22, and a cognitive processor 26 that processes an output comparison signal of comparator 24.

In operation, an unprocessed, or reference, audio signal 28 and a processed, or target, audio signal 30 are passed through, or processed in, peripheral ear processor 22 according to a mathematical auditory model of the human peripheral ear such that components of the signals 28, 30 are masked in a manner approximating the masking of an audio signal in the human ear. The resulting outputs 32 and 34, referred to as the basilar representation or basilar signal, from both the unprocessed and processed signals, respectively, are compared in comparator 24 to create an indication of the relative differences between the two signals, referred to as a basilar degradation signal 36 or excitation error. Basilar degradation signal 36 is essentially an error signal representing the error between the unprocessed and processed signals 28, 30 that has not been masked by the peripheral ear model. Basilar degradation signal 36 is then passed to cognitive processor 26 which employs a cognitive model to output an objective perceptual quality rating 38 based on monaural degradations and any shifts in the position of the binaural auditory image.

The peripheral ear model, or auditory model, is designed to model the underlying physical phenomena of simultaneous masking effects within a human ear. That is, the model considers the transfer characteristics of the middle and inner ear to form a representation of the signal corresponding to the mechanical to neural processing of the middle and inner ear. The model assumes that the mechanical phenomena of the inner ear are linear but not necessarily invariant with respect to amplitude and frequency. In other words, the spread of energy in the inner ear can be made a function of signal amplitude and frequency. The model also assumes the basilar membrane is sensitive to input energy according to a logarithmic sensitivity function, and that the basilar membrane has poor temporal resolution.

Figure 2:
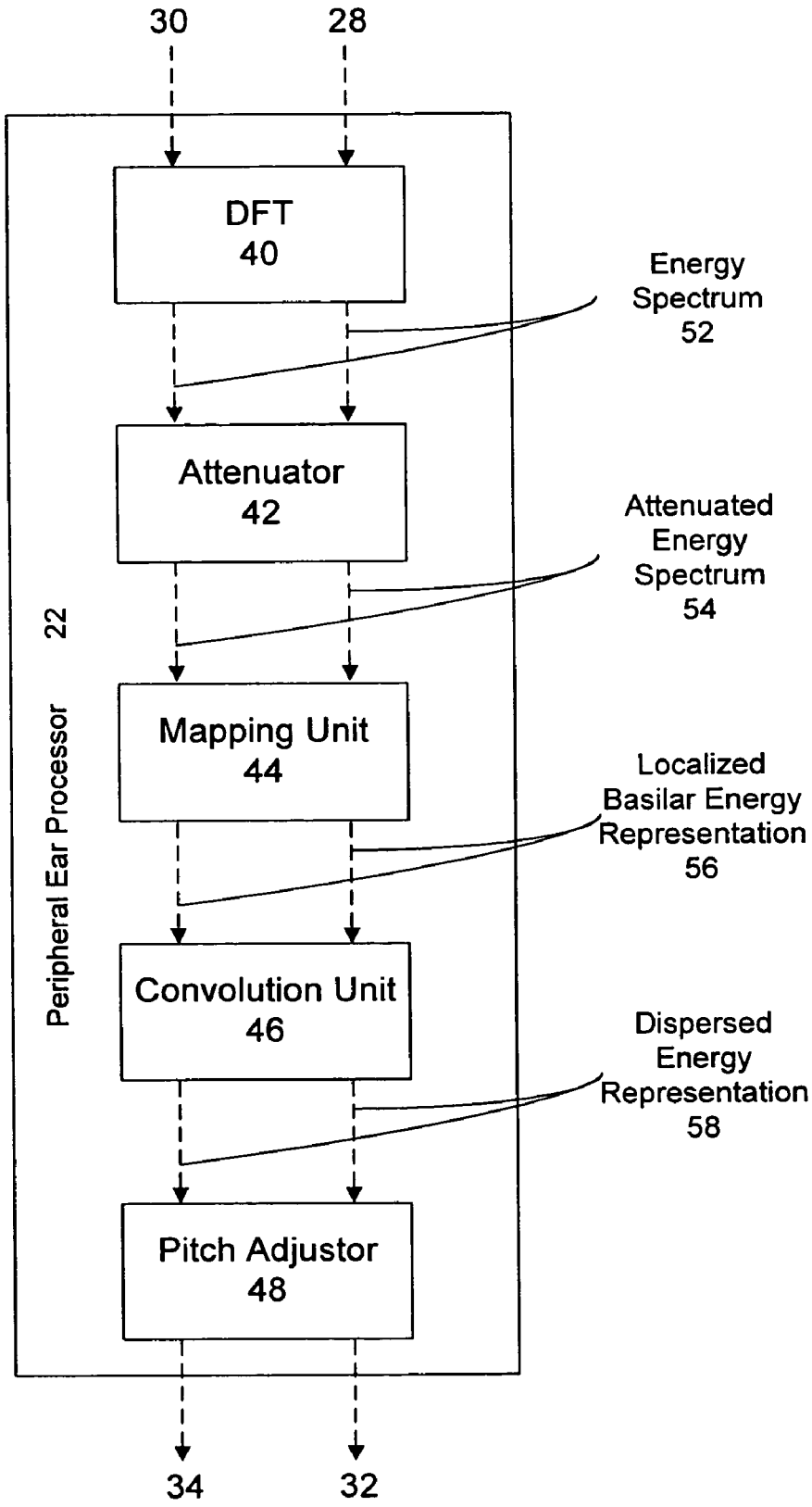
FIG. 2 shows successive stages of processing of the peripheral ear model.

Peripheral ear processor 22 is shown in greater detail in FIG. 2A, and consists of a discrete Fourier transform unit 40, an attenuator 42, a mapping unit 44, a convolution unit 46, and a pitch adjustor 48. In operation, the reference and target input signals 28 and 30 are processed as follows. Each input signal 28 or 30 is decomposed into a time-frequency representation, to provide an energy spectrum 52, by discrete Fourier transform (FDT) unit 40. Typically, a Hann window of approximately forty milliseconds is applied to the input signal, with a fifty percent overlap between successive windows. In attenuator 42, energy spectrum 52 is multiplied by a frequency dependent function which models the effect of the ear canal and the middle ear to provide an attenuated energy spectrum 54. Attenuated spectral energy value 54 is then mapped in mapping unit 44 from a frequency scale to a pitch scale to provide a localized basilar energy representation 56 that is generally more linear with respect to both the physical properties of the inner ear and observable psycho-physical effects. Localized basilar energy representation 56 is then convolved in convolution unit 46 with a spreading function to simulate the dispersion of energy along the basilar membrane to provide a dispersed energy representation 58. At pitch adjustor 48, dispersed energy representation 58 is adjusted through the addition of an intrinsic frequency-dependent energy to each pitch component to account for the absolute threshold of hearing, and converted to decibels to provide basilar sensation signal 32 or 34, as appropriate depending on the respective input signal. Basilar sensation signals 32 and 34 are also referred to herein as basilar membrane representations.

More specifically, in attenuator 42, energy spectrum 52 is multiplied by an attenuation spectrum of a low pass filter which models the effect of the ear canal and the middle ear. The attenuation spectrum, described by the following equation, is modified from that described in E. Terhardt, G. Stoll, M. Sweeman. "Algorithm for extraction of pitch and pitch salience from complex tonal signals." *J. Acoust. Soc. Am.* 71(3):678–688, 1982, in order to extend the high frequency cutoff by changing the exponent in equation 1 from 4.0 to 3.6.

$$A_{dB}=6.5\ e^{(-0.6(f-0.33)^2)}+10^{-3}f^{3.6}$$

where A is the attenuated value in decibels.

The resulting attenuated spectral energy values 54 are transformed in mapping unit 44 by a non-linear mapping function from the frequency domain to the subjective pitch domain using the Bark scale or other equivalent equal interval pitch scale. A commonly used mapping function is described in E. Zwicker and E. Terhardt. "Analytical expressions for critical-band rate and critical bandwidth as a function of frequency." *J. Acoust. Soc. Am.* 68(5):1523–1525, 1980:

$$B=1300\arctan(0.76\,f)+\arctan(f\ 17.5)^2$$

where B is pitch on the Bark scale. In the present invention, a new function is presently preferred to improve resolution at higher frequencies. The expression for this new function, where the frequency f is in Hz, is:

$$p=f/(9.0304615e{-}05\,f+2.6167612)$$

where p is pitch.

In convolution unit 46, the basilar membrane components of localized basilar energy representation 56 are convolved with a spreading function to simulate the dispersion of energy along the basilar membrane. The spreading function applied to a pure tone results in an asymmetric triangular excitation pattern with slopes that may be selected to optimize performance. The spreading is implemented by sequentially applying two IIR filters, $$H_1(z)=1/(1-a/z)\ \text{and}\ H_2(z)=1/(1-bz)$$

where the a and b coefficients are the reciprocals of the slopes of the spreading function on the dB scale.

With respect to pitch adjustor 48, a spreading function with a slope on the low frequency side (LSlope) of 27 dB/Bark and a slope on the high frequency side of −10 dB/Bark has been implemented. For the frequency-to-pitch mapping function given above, it has been found that predictions of audio quality ratings improved with fixed spreading function slopes of 24 and −4 dB/Bark, respectively.

The prior art literature indicates that the slope S of the spreading function on the low frequency side should be fixed (i.e., Lslope=0.27 dB/mel). However, on the high frequency side, the slope is said to vary with both signal level and frequency. That is, it increases with both decreasing level and increasing frequency. The following equation can be used for computing the higher frequency slope (S) as a function of frequency and level:

$$S_{dB/mel}=HSlope-LRate\cdot L_{dB}+FRate/F_{kHz}$$

Suggested values are 24 for HSlope, 230 for FRate and 0.2 for LRate. However, in a peripheral ear model, the optimal values for these parameters are dependent on other system components such as the frequency to pitch mapping function.

In the system of the present invention, parameter values for a particular system configuration using a function optimization procedure have been determined. Optimal values are those that minimize the difference between the model's performance and a human listener's performance in a signal detection experiment. This procedure allows the model parameters to be tailored so that it behaves like a particular listener, as detailed in Treurniet, W. C. "Simulation of individual listeners with an auditory model." *Proceedings of the audio Engineering Society,* Copenhagen, Denmark, Reprint Number 4154, 1996.

In other psychoacoustic models, the spreading function is applied to each pitch position by distributing the energy to adjacent positions according to the magnitude of the spreading function at those positions. Then the respective contributions at each position are added to obtain the total energy at that position. Dependence of the spreading function slope on level and frequency is accommodated by dynamically selecting the slope that is appropriate for the instantaneous level and frequency.

In system 20 of the present invention, to implement the dependence of the slope on level using the IIR filter implementation, a new procedure was developed. It is important to note that because convolution is a linear operation, the effects of convolving data with different spreading functions may be summed. Therefore, input values within particular ranges are convolved with level-specific spreading functions, and the results summed to approximate a single convolution with the desired dependence on signal level. Accuracy of the result may be traded off with computational load by varying the number of signal quantization levels.

A similar procedure can be used to include the dependence of the slope on both level and frequency. That is, the frequency range can also be divided into subranges, and levels within each subrange convolved with the level and frequency-specific IIR filters. Again, the results are summed to approximate a single convolution with the desired dependence on signal level and frequency.

Since the basilar membrane representation produced by the peripheral ear model is expected to represent only supraliminal aspects of the input audio signal, this information is the basis for simulating results of listening experiments. That is, ideally, the basilar sensation vector produced by the auditory model represents only those aspects of the audio signal that are perceptually relevant. However, the perceptual salience of audible basilar degradations can vary depending on a number of contextual or environmental factors. Therefore, the reference basilar membrane representations 32 and 34 and the basilar degradation vectors, or basilar degradation signal 36, are processed in various ways according to reasonable assumptions about human cognitive processing.

The result of processing according to the cognitive model is a number of components, described below, that singly or in combination produce perceptual quality rating 38. While other methods also calculate a quality measurement using one or more variables derived from a basilar membrane representation, for example as described in Thiede, supra, and J. G. Beerends, "Measuring the quality of speech and music codecs, an integrated psychoacoustic approach," *Proceedings of the Audio Engineering Society,* Copenhagen, Denmark, Reprint Number 4154, 1996, these methods process different variables and combinations of variables to produce an objective quality measurement.

In a presently preferred embodiment, the peripheral ear model processes a frame of data every 21 msec. Calculations for each frame of data are reduced to a single number at the end of a 20 or 30 second audio sequence. The most significant factors for determining objective perceptual quality rating 38 are presently believed to be: average distortion level; maximum distortion level; average reference level; reference level at maximum distortion; coefficient of variation of distortion; correlation between reference and distortion patterns; and, harmonic structure in the distortion.

In cognitive processor 26, a value for each of the above factors is computed for each of a discrete number of adjacent frequency ranges. This allows the values for each range to be weighted independently, and also allows interactions among the ranges to be weighted. Three ranges are typically employed: 0 to 1000 Hz, 1000 to 5000 Hz, and 5000 to 18000 Hz. An exception is the measure of harmonic structure of spectrum error that is calculated using the entire audible range of frequencies.

Accordingly, eighteen components result from the first six factors listed above when the three pitch ranges are considered in addition to the harmonic structure in the distortion variable for a total of nineteen components. The components are mapped to a mean quality rating of that audio sequence as measured in listening tests using a multi-layer neural network. Non-linear interactions among the factors are required because the average and maximum errors are weighted differentially as a function of the coefficient of variation. The use of a multilayer neural network with semi-linear activation functions allows this. The feature calculations and the mapping process implemented by the neural network constitute a task-specific model of auditory cognition.

Prior to processing according to the cognitive model, a number of pre-processing calculations are performed by cognitive processor 26, as described below. Essentially, these pre-processing calculations are performed in order to address the fact that the perceptibility of distortions is likely affected by the characteristics of the current distortion as well as temporally adjacent distortions. Thus, the pre-processing considers perceptual inertia, perceptual asymmetry, and the adaptive threshold for averaging A particular distortion is considered inaudible if it is not consistent with the immediate context provided by preceding distortions. This effect is herein defined as perceptual inertia. That is, if the sign of the current error is opposite to the sign of the average error over a short time interval, the error is considered inaudible. The duration of this memory is close to 80 msec, which is the approximate time for the asymptotic integration of loudness of a constant energy stimulus by human listeners. In practice, the energy is accumulated over time, and data from several successive frames determine the state of the memory. At each time step, the window is shifted one frame and each basilar degradation component of basilar degradation signal 36 is summed algebraically over the duration of the window. Clearly, the magnitudes of the window sums depend on the size of the distortions, and whether their signs change within the window. The signs of the sums indicate the state of the memory at that extended instant in time.

The content of an associated memory is updated with the distortions obtained from processing each current frame. However, the distortion that is output at each time step is the rectified input, modified according to the relation of the input to the signs of the window sums. If the input distortion is positive and the same sign as the window sum, the output is the same as the input. If the sign is different, the corresponding output is set to zero since the input does not continue the trend in the memory at that position. In particular, the output distortion at the ith position, $D_i$, is assigned a value depending on the sign of the ith window mean, $W_i$ and the ith input distortion, $E_i$.

$$\text{If}(\text{SGN}(E_i)\ \text{EQ}\ \text{SGN}(W_i)\ \text{AND}\ E_i\text{ST}\ 0.0)\ D_i=E_i$$

$$\text{If}(\text{SGN}(E_i)\ \text{NE}\ \text{SGN}(W_i))\ D_i=0.0$$

Negative distortions are treated somewhat differently. There are indications in the literature on perception, for example in E. Hearst. "Psychology and nothing." *American Scientist,* 79:432–443, 1979, and M. Triesman. "Features and objects in visual processing." *Scientific American,* 255 [5]:114–124, 1986, that information added to a visual or auditory display is more readily identified than information taken away, resulting in perceptual asymmetry. Accordingly, the system of the present invention weighs less heavily the relatively small distortions resulting from spectral energy removed from, rather than added to, the signal being processed. Because it is considered less noticeable, a small negative distortion receives less weight than a positive distortion of the same magnitude. As the magnitude of the error increases, however, the importance of the sign of the error should decrease. The size of the error at which the weight approaches unity was somewhat arbitrarily chosen to be Pi, as shown in the following equation.

$$\text{If}\ (\text{SGN}(E_i)\ \text{EQ}\ \text{SGN}(W_i)\ \text{AND}\ E_i\text{LT}\ 0.0)$$

$$D_i=|E_i|*\arctan(0.5*|E_i|)$$

where ‖ represents the absolute value and * is the scalar multiplication.

With respect to the adaptive threshold for averaging, the distortion values obtained from the memory can be reduced to a scalar simply by averaging. However, if some pitch positions contain negligible values, the impact of significant adjacent narrow band distortions would be reduced. Such biasing of the average can be prevented by ignoring all values under a fixed threshold, but frames with all distortions under that threshold would then have an average distortion of zero. This also seems like an unsatisfactory bias. Instead, an adaptive threshold has been chosen for ignoring relatively small values. That is, distortions in a particular pitch range are ignored if they are less than a fraction (eg. one-tenth) of the maximum in that range.

The average distortion over time for each pitch range is obtained by summing the mean distortion across successive non-zero frames. A frame is classified as non-zero when the sum of the squares of the most recent 1024 input samples exceeds 8000, i.e., more than 9 dB per sample on average.

To determine the average distortion level for each analysis frame, the perceptual inertia and perceptual asymmetry characteristics of the cognitive model transform the basilar error vector into an echoic memory vector which describes the extent of the degradation over the entire range of auditory frequencies. These resulting values are averages for each pitch range with the adaptive threshold set at 0.1 of the maximum value in the range, and the final value is obtained by a simple average over the frames.

The maximum distortion level is obtained for each pitch range by finding the frame with the maximum distortion in that range. The maximum value is emphasized for this calculation by defining the adaptive threshold as one-half of the maximum value in the given pitch range instead of one-tenth that is used above to calculate the average distortion.

The average reference level over time is obtained by averaging the mean level of the reference signal in each pitch range across successive non-zero frames.

The reference level at maximum distortion in each pitch region is the reference level that corresponds to the maximum distortion level calculated as described above.

The coefficient of variation is a descriptive statistic that is defined as the ratio of the standard deviation to the mean. The coefficient of variation of the distortion over frames has a relatively large value when a brief, loud distortion occurs in an audio sequence that otherwise has a small average distortion. In this case, the standard deviation is large compared to the mean. Since listeners tend to base their quality judgments on this brief but loud event rather than the overall distortion, the coefficient of variation may be used to differentially weight the average distortion versus the maximum distortion in the audio sequence. It is calculated independently for each pitch region.

When the peak magnitudes of the distortion coincide in pitch with the peak magnitudes of the reference signal, perceptibility of the distortion may be differentially affected. The correlation C between the distortion (E) and reference (R) vectors can reflect this coincidence, and is found by calculating the cosine of the angle between the vectors for each pitch region as follows:

$$C = \frac{\vec{R} \cdot \vec{E}}{|\vec{R}| * |\vec{E}|}$$

where • is the dot product operator, ‖ is the magnitude of the enclosed vector and * is the scalar multiplication.

The threshold for a noise signal is lower by as much as 8 dB when a masker has harmonic structure than when it is inharmonic. This indicates that quantization noise resulting from lossy audio coding has a lower threshold of perceptibility when the reference signal, or masker, has harmonic structure. It is, therefore, possible to adjust an estimate of the perceptibility of the quantization noise given by existing psychoacoustic models, and the predict the required threshold adjustment. The improved threshold prediction can be used in the assignment of bits in a lossy audio coding algorithm, and in predicting noise audibility in an objective perceptual quality measurement algorithm.

It is generally accepted that the auditory system transforms an audio signal to a time-place representation at the basilar membrane in the inner ear. That is, the energy of the basilar membrane vibration pattern at a particular location depends on the short-time spectral energy of the corresponding frequency in the input signal. When the signal is a complex masker composed of a number of partials, interaction of neighboring partials result in local variations of the basilar membrane vibration pattern, often referred to as "beats". The output of an auditory filter centered at the corresponding frequency has an amplitude modulation corresponding to the vibration pattern at that location. To a first approximation, the modulation rate for a given filter is the difference between the adjacent frequencies processed by that filter. Since this frequency difference is constant over all filters for a harmonic masker, the output modulation rates are also constant. For an inharmonic masker, however, the frequency difference between adjacent partials is not constant over all auditory filters, so the output modulation rates also differ. The pattern of filter output modulations can be simulated using a bank of filters with impulse responses similar to those of the filtering mechanisms at the basilar membrane.

A cue for detecting the presence of low level noise is a change in the variability of these filter output modulation rates. The added noise randomly alters the variance of the array of auditory filter output modulation rates, and the change in variance is more easily discerned against a background of no variance due to the harmonic masker than against the more variable background due to the inharmonic masker. Therefore, a simple signal detection model predicts a higher threshold for noise embedded in an inharmonic masker than when it is embedded in a harmonic masker. A visual analogy would be detection of a letter in a field of random letters, versus detection of the same letter in a field of Os. An inharmonicity calculation based on the variability of filter envelope modulation rates reflects a difference between harmonic and inharmonic maskers, and can be used to adjust an initial threshold estimate based on masker energy. The adjusted threshold can be applied to the basilar degradation signal 36 to improve objective audio quality measurement of system 20.

A filter bank with appropriate impulse responses, such as the gammatone filter bank described in Slaney, M. (1993). "An efficient implementation of the Patterson-Holdsworth auditory filter bank", Apple Computer Technical Report #35, Apple Computer Inc., is implemented to process a short segment of the masker. The center frequencies of successive filters are incremented by a constant interval on a linear or nonlinear frequency scale. The output of each filter is processed to obtain the envelope, for example, by applying a Hilbert transform. An autocorrelation is applied to the envelope to give an estimate of the period of the dominant modulation frequency. Finally, a measure of inharmonicity, $R_v$, is calculated as the variance of the modulation rates across filters represented by these periods. An initial threshold estimate, EstThrest, is based on other psychoacoustic information such as the average power of the filter envelopes. An adjusted threshold is calculated based on this estimate and some function of the modulation rate variance as expressed in the following equation.

$$AdjThresh_{dB} = EstThresh_{dB} + f(R_v)$$

For example, we have found the following equation useful.

$$AdjThresh_{dB}=EstThresh_{dB}+2\log_{10}(R_v)-13.75$$

The threshold given by the above equation successfully predicts the consistent differences in masked threshold obtained with harmonic and inharmonic maskers.

Audio coding algorithms are currently forced to be conservative (i.e., assign more bits than necessary) in the bit assignment strategy in order to accommodate incorrect threshold predictions resulting from source harmonicity. The masked threshold correction given above will allow such algorithms to distinguish between the masking effectiveness of harmonic and inharmonic sources, and to be less conservative (i.e., assign fewer bits) when the source is inharmonic. This will enable lower bit rates while maintaining audio quality.

Similarly, objective perceptual quality measurement algorithms will be more accurate by taking into account the shift in threshold resulting from source harmonicity.

Listeners may respond to some structure of the error within a frame, as well as to its magnitude. Harmonic structure in the error can result, for example, when the reference signal has strong harmonic structure, and the signal under test includes additional broadband noise. In that case, masking is more likely to be inadequate at frequencies where the level of the reference signal is low between the peaks of the harmonics. The result would be a periodic structure in the error that corresponds to the structure in the original signal.

The harmonic structure is measured in either of two ways. According to a first embodiment, it is described by the location and magnitude of the largest peak in the spectrum of the log energy auto-correlation function. The correlation is calculated as the cosine between two vectors. According to a second embodiment, the periodicity and magnitude of the harmonic structure is inferred from the location of the peak with the largest value in the cepstrum of the error. The relevant parameter is the magnitude of the largest peak. In some cases, it is useful to set the magnitude to zero if the periodicity of the error is significantly different from that of the reference signal. Specifically, if the difference between the two periods is greater than one-quarter of the reference period, the error is assumed to have no harmonic structure related to the original signal.

The mean quality ratings obtained from human listening experiments is predicted by a weighted non-linear combination of the nineteen components described above. The prediction algorithm is optimized using a multilayer neural network to derive the appropriate weightings of the input variables. This method permits non-linear interactions among the components which is required to differentially weight the average distortion and the maximum distortion as a function of the coefficient of variation.

In a currently employed embodiment of system 20, relating the above components to human quality ratings was calibrated using data from eight different listening tests that used the same basic methodology. These experiments were known in the ITU-R Task Group 10/4 as MPEG90, MPEG91, ITU92CO, ITU92DI, ITU93, MPEG95, EIA95, and DB2. Generalization testing was performed using data from the DB3 and CRC97 listening tests.

With reference to FIGS. 2B—12, examples of the processing of a representative reference signal and test signal is described. FIGS. 3 and 4 show a reference spectrum and test spectrum, respectively. The spectra 100 and 102 of FIGS. 3 and 4, resulting from discrete Fourier transform operations, were processed to provide representative masking by the outer and middle ear. The results of the masking, the attenuated energy spectra 104 and 106, are shown in FIGS. 5 and 6. The basilar representations or excitations resulting 108 and 110, are shown in FIGS. 9 and 10. These representations are subsequently compared at step 111 to provide an excitation error signal 112, and as shown in FIG. 11. Pre-processing of the excitation error signal 114 is shown in FIG. 12, and determines the effects of perceptual inertia and asymmetry for use within the cognitive model 116.

Additional input for the cognitive model 116 is provided by a comparison 118 of the reference and test spectra to create an error spectrum 120 as shown in FIG. 7. The error spectrum 120 is used to determine the harmonic structure 122, as shown in FIG. 8, for use within the cognitive model 116. The cognitive model 116 provides a discrete output of the objective quality of the test signal through the calculation, averaging and weighting of the input variables through a multi-layer neural network.

The number of cognitive model components utilized to provide objective quality measure 38 is dependent on the desired level of accuracy in the quality measure. That is, an increased level of accuracy will utilize a larger number of cognitive model components to provide the quality measure. Experimentally, it has been found that a combination of the above-identified nineteen components provides the best objective measurement of audio quality.

The system and process of the present invention are implemented using appropriate computer systems enabling the target and reference audio sequences to be collected and processed. Appropriate computer processing modules are utilized to process data within the peripheral ear model and cognitive model in order to provide the desired objective quality measure. The system may also include appropriate hardware inputs to allow the input of processed and unprocessed audio sequences into the system. Therefore, once the neural network of the cognitive processor has been appropriately trained, suitable reference and target sources can be input to the present system and it can automatically perform objective audio quality measurements. Such a system can be used for automated testing of audio signal quality, particularly the Internet and other telecommunications networks. When unacceptable audio quality is detected, operators can be advised, and/or appropriate remedial actions can be taken. In addition, the present invention can be used to measure the quality of devices such as A/D and D/A converters and perceptual audio (or speech) codecs.

The above-described embodiments of the invention are intended to be examples of the present invention. Alterations, modifications and variations may be effected to the particular embodiments by those of skill in the art, without departing from the scope of the invention which is defined solely by the claims appended hereto.

We claim:

1. A process for determining an objective measurement of audio quality, comprising the steps of:

(i) processing a reference audio signal and a target audio signal according to a peripheral ear model to provide a reference basilar sensation signal and a target basilar sensation signal, respectively;

(ii) comparing the reference basilar sensation signal and the target basilar sensation signal to provide a basilar degradation signal;

(iii) processing the basilar degradation signal according to a cognitive model to determine a plurality of cognitive model components; and (iv) calculating an objective perceptual quality rating based on the plurality of cognitive model components, the objective perceptual quality rating quantifying the perceptual difference in acoustic quality between the reference audio signal and the target audio signal.

2. A process according to claim 1, wherein at least one of the plurality of cognitive model components is selected from average distortion level, maximum distortion level, average reference level, reference level at maximum distortion, coefficient of variation of distortion, and correlation between reference and distortion patterns.

3. A process according to claim 1, further including steps of:

(a) calculating a harmonic structure in an error spectrum obtained through a comparison of the reference and target audio signals; and (b) processing the basilar degradation signal and the harmonic structure according to the cognitive model.

4. A process according to claim 1, wherein step (ii) includes using one of a level-dependent and a frequency dependent spreading function having a recursive filter.

5. A process according to claim 1, wherein step (ii) includes using a recursive filter implementation of a spreading function.

6. A process according to claim 1, wherein step (iv) includes weighting separately for adjacent frequency ranges.

7. A process according to claim 1, further including a step of determining effects of at least one of perceptual inertia, perceptual asymmetry and adaptive threshold.

8. A process according to claim 1, further including a step of adjusting the basilar degradation signal in accordance with a variance of auditory filter envelope modulation rates of the reference audio signal.

9. A system for determining an objective audio quality measurement of a target audio signal, comprising:

a peripheral ear processor for processing a reference audio signal and a target audio signal to provide a reference basilar sensation signal and a target basilar sensation signal, respectively;

a comparator for comparing the reference basilar sensation signal and the target basilar sensation signal to determine a basilar degradation signal; and a cognitive processor for processing the basilar degradation signal to determine a plurality of cognitive model components for providing an objective perceptual quality rating quantifying the perceptual difference in acoustic quality between the reference audio signal and the target audio signal, the perceptual quality rating determined based on the plurality of cognitive model components.

10. A system according to claim 9, wherein at least one of the plurality of cognitive model components is selected from an average distortion level, maximum distortion level, average reference level, reference level at maximum distortion, coefficient of variation of distortion, and correlation between reference and distortion patterns.

11. A system according to claim 9, wherein the peripheral ear processor further provides a harmonic structure from an error spectrum obtained through a comparison of the reference and target audio signals.

12. A system according to claim 9, wherein the cognitive processor includes a multi-layer neural network.

13. A system according to claim 9, wherein the cognitive processor includes pre-processing means for determining effects of at least one of perceptual inertia, perceptual asymmetry and adaptive threshold.

14. A system according to claim 9, wherein the peripheral ear processor includes a recursive filter.

15. A system according to claim 9, wherein the cognitive processor includes weighting means for adjacent frequency ranges.

16. A system according to claim 9, wherein the cognitive processor includes adjustment means for adjusting the basilar degradation signal according to a variance of auditory filter envelope modulation rates of the reference audio signal.

* * * * *

UNITED STATES PATENT AND TRADEMARK OFFICE

CERTIFICATE OF CORRECTION

PATENT NO. : 7,164,771 B1
APPLICATION NO. : 09/577649
DATED : January 16, 2007
INVENTOR(S) : William C. Treurniet, Louis Thibault and Gilbert Arthur Joseph Soulodre It is certified that error appears in the above-identified patent and that said Letters Patent is hereby corrected as shown below:

On The Title Page, Item (75) 3rd Inventor's name should read Gilbert Arthur Joseph Soulodre Signed and Sealed this Third Day of April, 2007

JON W. DUDAS
*Director of the United States Patent and Trademark Office*